US007168798B2

(12) United States Patent
Samii et al.

(10) Patent No.: US 7,168,798 B2
(45) Date of Patent: Jan. 30, 2007

(54) HYBRID INK DELIVERY SYSTEM

(75) Inventors: Mohammad M Samii, La Jolla, CA (US); Daniel L Briley, Escondido, CA (US); Victor T. Escobedo, Bonita, CA (US); Max S Gunther, Ridgecrest, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 273 days.

(21) Appl. No.: 10/832,069

(22) Filed: Apr. 26, 2004

(65) Prior Publication Data

US 2006/0152560 A1 Jul. 13, 2006

(51) Int. Cl.
*B41J 2/17* (2006.01)
*B41J 2/175* (2006.01)

(52) U.S. Cl. ..... 347/86; 347/84; 347/85

(58) Field of Classification Search ..... 347/84–86
See application file for complete search history.

(56) References Cited

U.S. PATENT DOCUMENTS

RE37,874 E * 10/2002 Pawlowski et al. ..... 347/86
6,877,849 B2 * 4/2005 Gonzales ..... 347/86
2004/0135859 A1 * 7/2004 German et al. ..... 347/95

* cited by examiner

*Primary Examiner*—Manish S. Shah
*Assistant Examiner*—Kainoa Wight
(74) *Attorney, Agent, or Firm*—Larry Baker

(57) ABSTRACT

Embodiments of the present invention include hybrid ink delivery systems which allow a flexible arrangement of free ink supplies to be connected to multiple printhead assemblies, while preventing printhead deprime or drooling during setup, and provide control and verification of ink supply replacement through the use of integral memory components on the in supplies.

20 Claims, 7 Drawing Sheets

HYBRID INK DELIVERY SYSTEM

BACKGROUND OF THE INVENTION

This invention relates to thermal inkjet (TIJ) printers, and more particularly to printing systems adaptable to specialized printing needs.

TIJ printers typically include a TIJ pen which includes a reservoir of ink coupled to the TIJ printhead. One type of TIJ printer has an ink reservoir which is ordinarily maintained under a sub-atmospheric or negative pressure so that ink will not leak or drool from the printhead. Various types of ink reservoirs may be used, including refillable ink reservoir cartridges which are mounted on the moveable printer carriage, throwaway replaceable cartridges which are mounted on the printer carriage, and remote or offboard ink reservoirs from which ink is brought to the printhead on the printer carriage by tubing.

In specialized printing applications it may be desirable to configure a system with multiple printhead assemblies fed from "off axis" ink containers; to reduce down time, it is desirable that the ink containers be capable of being replaced when empty without shutting down printing. It is also desirable that printheads not deprime or drool as the system is being configured, and that mechanisms exist to prevent printing errors, such as the use of a wrong ink type.

SUMMARY OF THE INVENTION

Embodiments of the present invention include hybrid ink delivery systems which allow a flexible arrangement of free ink supplies to be connected to multiple printhead assemblies, while preventing printhead deprime or drooling during setup, and provide control and verification of ink supply replacement through the use of integral memory components on the in supplies.

Other aspects and advantages of the present invention will become apparent from the following detailed description, taken in conjunction with the accompanying drawings, illustrating by way of example the principles of the invention.

DESCRIPTION OF THE EMBODIMENTS OF THE INVENTION

U.S. Pat. No. 6,341,853 ("Continuous Refill Of Spring Bag Reservoir In An Ink-Jet Swath Printer/Plotter") discloses a closed ink replenishment system for replenishing the supply of ink in negative pressure spring-bag reservoirs in a printer/plotter. A tube runs between each cartridge reservoir and an auxiliary reservoir mounted to the printer/plotter frame to form the closed ink system. As ink is depleted from the spring-bag reservoir during printing operation, the negative pressure in the cartridge increases, drawing ink through the tube from the auxiliary reservoir into the cartridge until the negative pressure decreases to an equilibrium point. As a result, the volume of ink within the spring-bag reservoir remains substantially constant so long as there is ink remaining within the auxiliary reservoir.

Such a closed ink replenishment system may be used to form specialized printing systems. Such systems, however, have several drawbacks which can impact their performance. First, during setup of such systems, the printheads are susceptible to either catastrophic depriming or drooling from the nozzles if the printheads or ink supplies are raised or lowered substantially with respect to one another. Second, such systems may not provide mechanisms to prevent human errors, such as the use of a wrong ink type.

Embodiments of the present invention include "hybrid" systems which incorporate an additional pressure regulator in the ink path, which may be used to regulate pressure to multiple printheads. A plurality of ink supplies may be manifolded together to provide ink to each regulator, allowing for lower intervention rates by operators, since contents of several ink containers may be depleted before replacement is necessary.

Embodiments of the hybrid ink delivery system also incorporate electronic memory components on the ink supplies, which enable electronic keying of ink supplies and automation within a specialized printing system, such as insuring that the correct ink is used for a particular print job, as discussed below.

Figure 1:
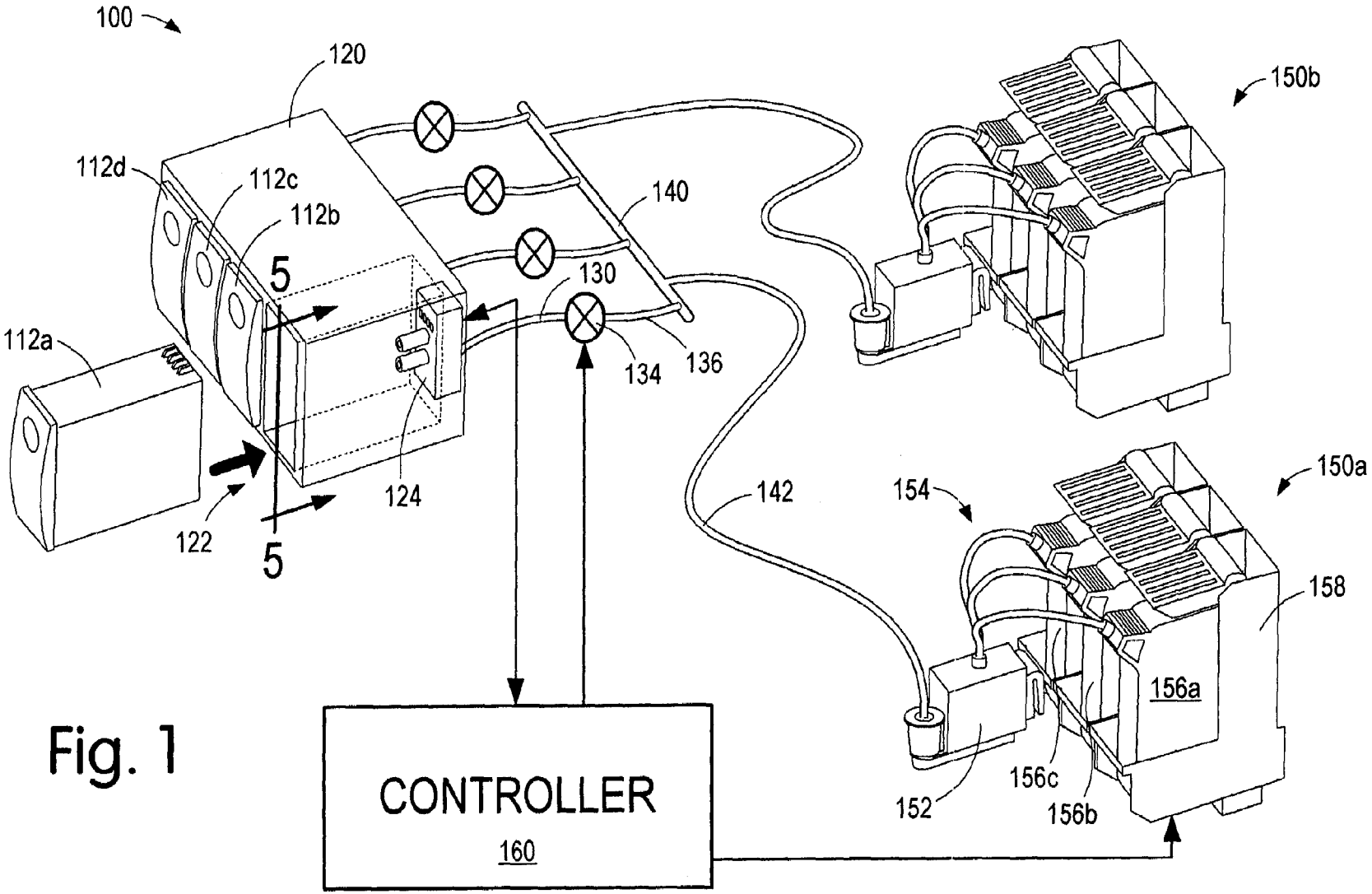
FIG. 1 is a schematic overview representation of an embodiment of the ink delivery system according to the present invention.

FIG. 1 is a schematic overview representation of an embodiment of the ink delivery system 100 according to the present invention. The ink delivery system utilizes replaceable ink containers 112*a*, 112*b*, 112*c*, 112*d* which are installed in a receiving station 120. Although four ink containers are shown in FIG. 1, different numbers of ink containers may be used instead, including a single ink container. Each container is installed in an ink container receiving slot 122 (for clarity, only one is illustrated), where they mate with a floating platform 124 that includes air, ink, and electrical interconnects, as described below.

Ink from the containers 112*a*, 112*b*, 112*c*, 112*d* passes through tubing 130 to valves 134, which enable individual connection of the ink supplies to an ink manifold 140, through additional tubing 136. The valves allow sequential use of the ink containers and permit replacement of individual containers without terminating printing, as discussed below. The tubing 130, manifold 140, and additional tubing 136 are shown for illustration purposes as separate elements, but may take any number of forms, such as a single integral assembly, as is known in the art.

From the manifold 140 ink passes through flexible tubing 142 to one or more carriage assemblies 150*a*, 150*b*. Two carriage assemblies are illustrated in FIG. 1, but a manifold may feed a different number of carriage assemblies, or only a single assembly. Flexible tubing 142 allows the carriage assemblies to reciprocate across a print swath, while the ink supplies remain fixed.

On each carriage assembly, the ink is received by a regulator assembly 152, which controls backpressure to one or more printheads, as discussed below. From the regulator assembly 152 ink passes through tubing 154 to one or more cartridges 156*a*, 156*b*, 156*c* having printheads. The cartridges may be replenishable ink cartridges that provide some degree of backpressure regulation independent of the regulator 152, as also discussed below. Although three cartridges 156*a*, 156*b*, 156*c* are shown on each of carriage assemblies 150*a*, 150*b*, a regulator 152 may feed a different number of cartridges, or only a single cartridge. The carriage assemblies 150*a*, 150*b*, include mechanical housings 158 for retaining the cartridges, and for mounting the regulator; and may also include electrical connectors for allowing communication between the controller and the printheads (not shown).

An electronic controller 160 provides print data to each of the carriage printheads; controls the sequencing of valves 134, and interacts with the integral memory devices of the ink containers 112*a*, 112*b*, 112*c*, 112*d*, as discussed below. The controller 160 may also interact with an operator interface (not shown) to provide information to the operator or to prompt the operator regarding status or error conditions, as also discussed below.

Figure 2:
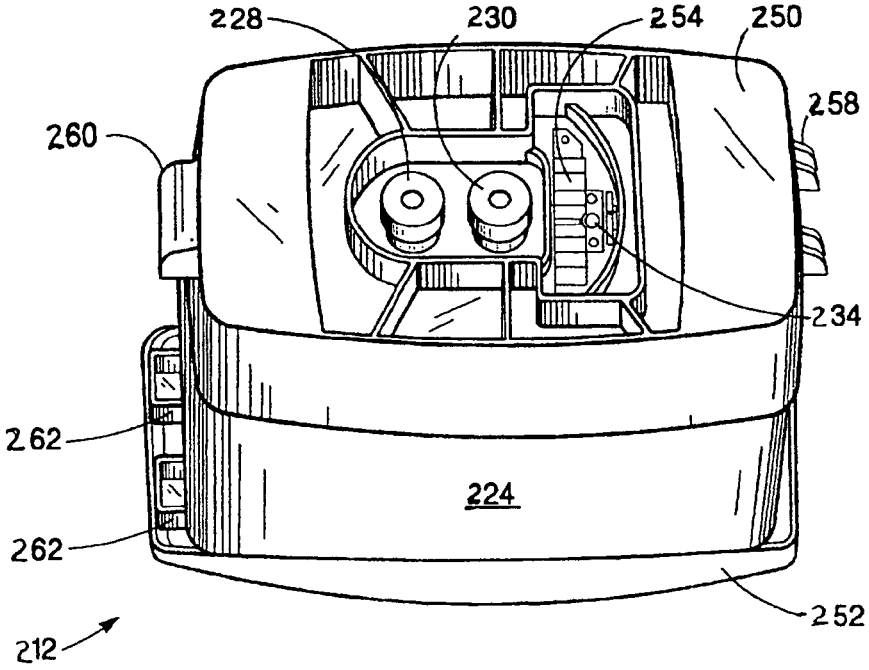
FIG. 2 is a perspective view of one embodiment of an ink container that may be used with embodiments of the ink delivery system.
Figure 3:
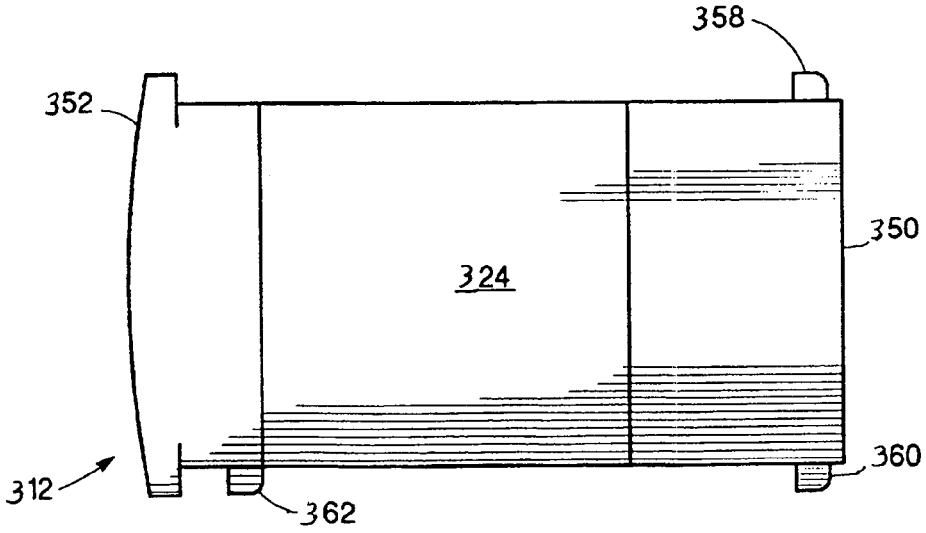
FIG. 3 is a side plan view of the ink container shown in FIG. 2.

FIGS. 2 and 3 illustrate an exemplary ink container 212, 312 such as might be used with the ink delivery system of the present invention, and which is described in further detail in U.S. Pat. No. 6,113,228, ("Ink Container for Compact Supply Station"). The ink container 212, 312 includes a housing or outer shell 224 which contains the fluid reservoir (not visible in FIGS. 2 and 3). The outer shell 224 has a leading edge 250, 350 and trailing edge 252, 352 relative to a direction of insertion for the ink container 212, 312 into the receiving station 120. The leading edge 250, 350 includes the air inlet 228 and the fluid outlet 230 which are configured to allow air to enter the container and ink to leave the container, respectively, once the ink container 212, 312 is properly inserted into the receiving station 120. The exemplary ink container 212, 312 is configured to contain "free" ink (rather than holding ink in a capillary material).

A plurality of electrical contacts 254 are disposed on the leading edge 250 for providing electrical connection between the ink container 212 and printer controller 160. In one preferred embodiment the plurality of electrical contacts 254 include a first plurality of electrical interconnects that are electrically interconnected to the information storage device 234 and a second plurality of electrical interconnects which are electrically interconnected to the ink volume sensor (not visible in FIG. 2). In the preferred embodiment the information storage device 234 is a semiconductor memory, as discussed below, and the ink volume sensing device is an inductive sensing device. The electrical contacts 254 will be discussed in more detail with respect to FIGS. 5 and 6.

The ink container 212, 312 includes one or more keying and guiding features 258, 358 and 260, 360 disposed toward the leading edge 250, 350 of the ink container. The keying and guiding features work in conjunction with corresponding keying and guiding features on the receiving station 120 to assist in aligning and guiding the ink container during insertion of the ink container into the receiving station. The keying and aligning features 258, 358 and 260, 360 in addition to providing a guiding function also provide a keying function to insure only ink containers 212, 312 having proper ink parameters such as proper color and ink type are inserted into a given slot of receiving station 120.

A latch feature 262, 362 is provided toward the trailing edge 252, 352 of the ink container. The latch feature works in conjunction with corresponding latching features on the printer (not illustrated) to secure the ink container within the receiving station 120 such that proper interconnects such as air, fluidic and electrical are accomplished in a reliable manner. The latching feature 262, 362 is a molded tang, which extends downwardly relative to a gravitational frame of reference.

Figure 4:
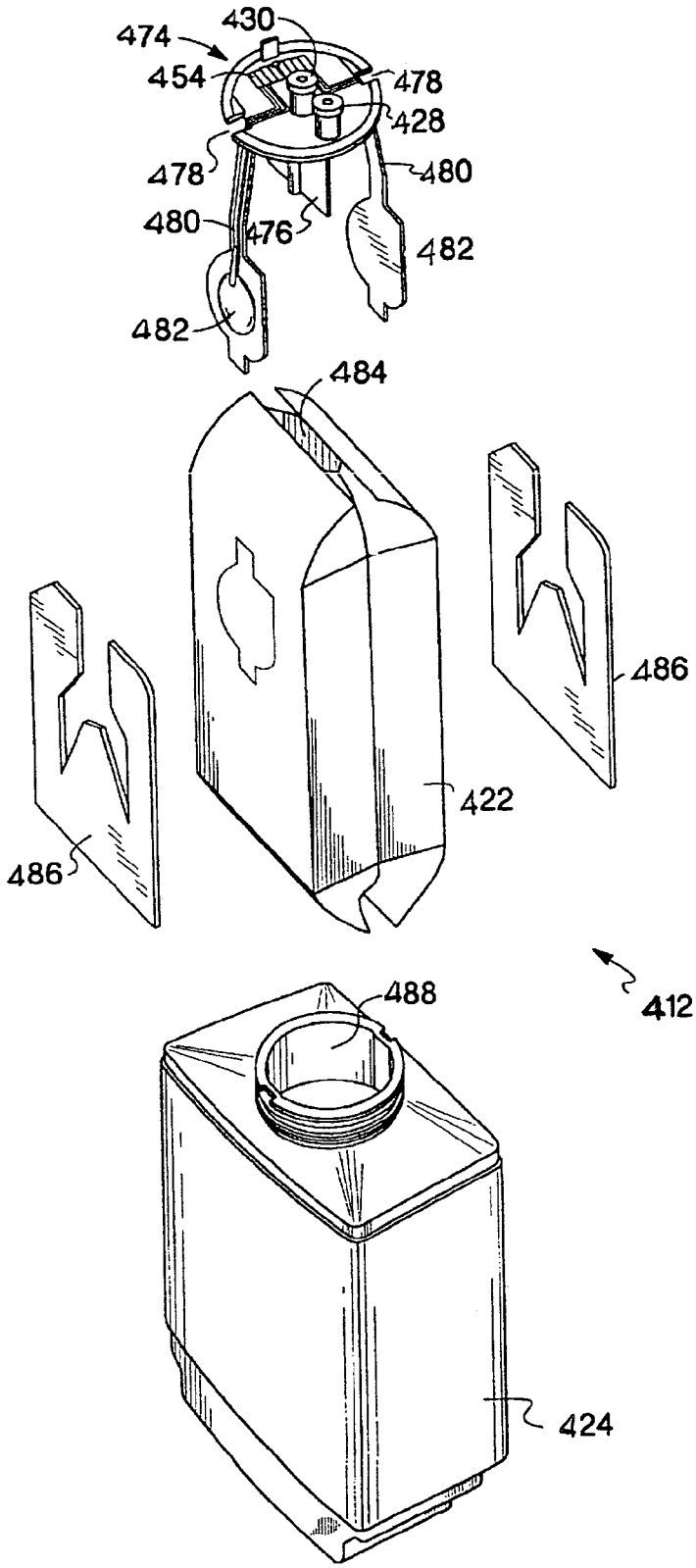
FIG. 4 is an exploded view shown in perspective of the ink container shown in FIG. 2.

FIG. 4 shows an exploded view of the exemplary ink container 412 shown without the leading edge 250, 350 and trailing edge 252, 352. The ink container 412 includes a chassis 474 that includes a tower-shaped air inlet 428, a tower-shaped fluid outlet 430, the information storage device (not visible in FIG. 4), the plurality of electrical contacts 454, and a keel shaped attachment surface 476. An electrical pathway 478 is attached to the chassis 474 that allows the routing of electrical conductors 480 between electrical contacts 454 and a sensor 482. The attachment surface 476 of the chassis 474 is configured to be received in an opening 484 in the ink reservoir 422. In one embodiment, the ink reservoir 422 is a pleated bag that is attached to the attachment surface 476 to form a seal between the ink reservoir 422 and the chassis 474. Fluid communication is established between the fluid outlet 430 and the ink reservoir 422 through the chassis 474. Stiffeners 486 are attached to the ink reservoir 422 to provide a more controlled collapse of the reservoir 422. In one embodiment the sensor 482 measures a separation between sidewalls of the ink reservoir 422. The ink reservoir is configured to collapse in a controlled manner so that ink level can be inferred from an output signal from the sensor 482.

The outer shell 424 is preferably a bottle-shaped structure with an opening 488 for receiving a peripheral surface of the chassis 474. The outer shell 424 is fabricated using combined blow molding and injection molding. An exemplary material suitable for the outer shell 424 is polyethylene having a typical thickness of approximately 2 millimeters.

Air inlet 428 may be opened to ambient air pressure, with the ink pressure required to provide ink to the ink delivery system provided by gravity, or the air inlet may provide for pressurizing of the outer shell 424, to provide a higher ink pressure.

Figure 5:
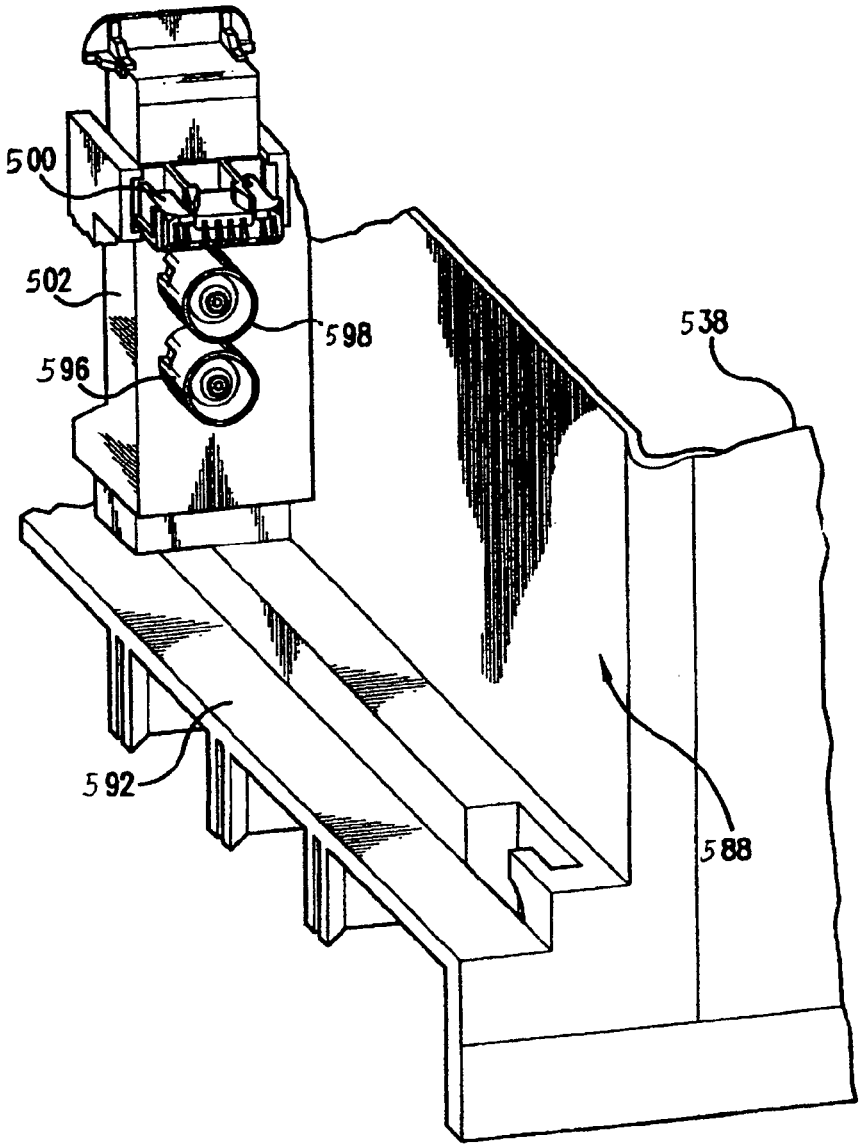
FIG. 5 is an enlarged partial isometric and cut away view of the ink container receiving station of an embodiment of the ink delivery system taken along the line 5—5 of FIG. 1.

FIG. 5 illustrates a single exemplary ink container receiving slot 588 (122 on FIG. 1) within the ink container receiving station 120. Slot 588 includes interconnect portions for interconnecting with the ink container. In the preferred embodiment these interconnect portions include a fluid inlet 598, an air outlet 596 and an electrical interconnect portion 500. Each of the interconnects 596, 598, and 500 are positioned on a floating platform 502 which is biased by coil springs (not visible) toward the installed ink container. Fluid inlet 598 and air outlet 596 are configured for connection with the corresponding fluid outlet and air inlet, respectively, on the ink container. The electrical interconnect 500 is configured for engaging electrical contacts on the ink container.

It is the interaction between the keying and guiding features of the ink container and the corresponding keying and guiding slots 592 associated with the ink container receiving station 120 which guide the ink container during the insertion such that proper interconnection is accomplished between the ink container and the printing system. In addition, sidewalls associated with each slot in the ink container receiving station 588 engage outer surfaces of ink container to assist in guiding and aligning ink container during insertion into slot 592.

Figure 6:
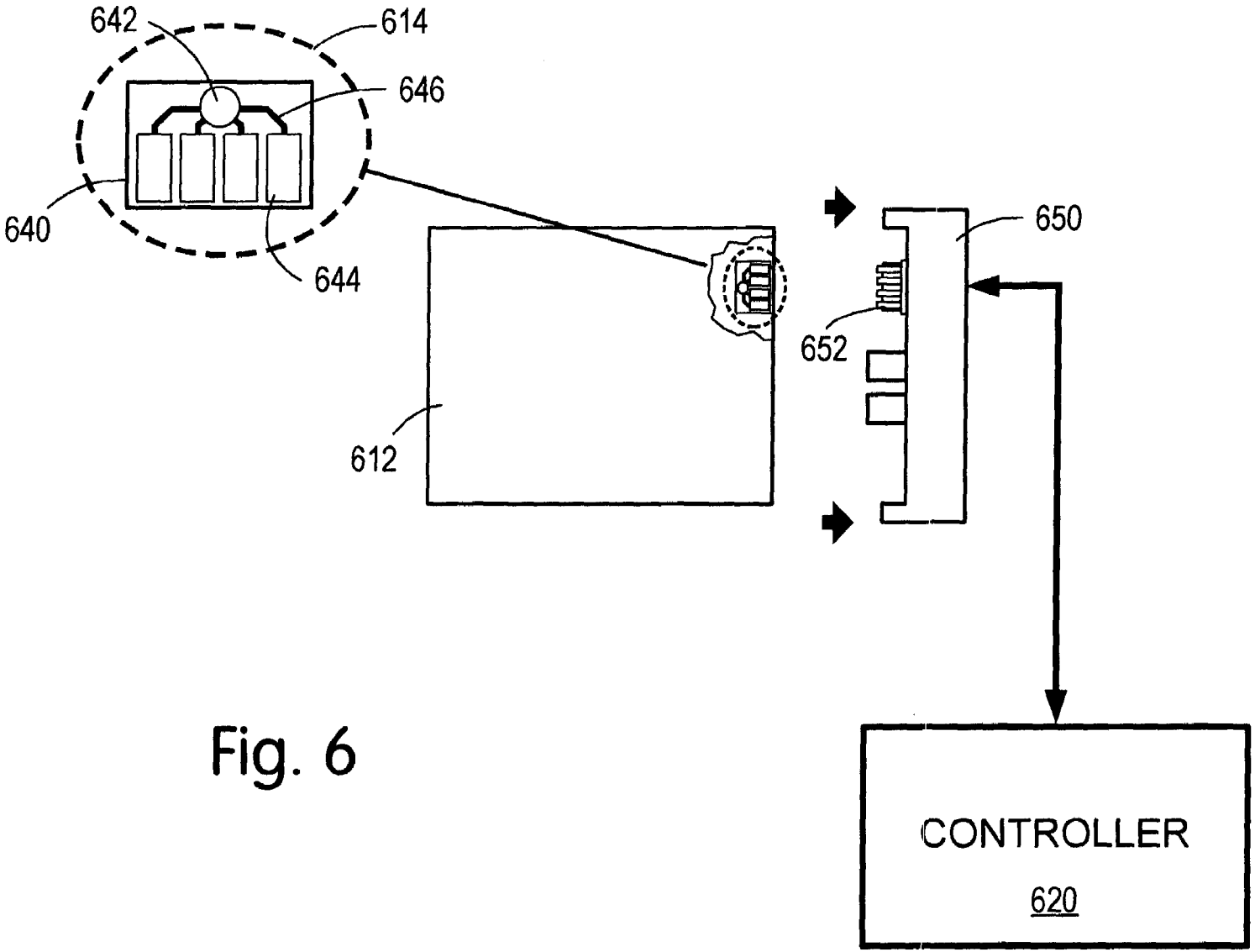
FIG. 6 is a schematic representation of an embodiment of the electronic memory portion of the ink delivery system, illustrating the interconnections to the integral memory component of an ink container.

FIG. 6 illustrates one exemplary embodiment of ink container 612 with an integral memory component 614. In the embodiment of FIG. 6, the memory component includes electrical contacts for mating with an external electrical connector. The memory component 614 is formed as a small printed circuit assembly 640, with a plurality of printed electrical contacts 644 for mating with an external connector 652 on a receiving station 650. Printed wiring 646 on the printed circuit assembly provides electrical communication between the electrical contacts and integrated circuit memory 642, which in the exemplary embodiment is encapsulated in a protective material such as epoxy.

Typical memory components 614 include forms of electronic non-volatile memory, such Electrically Erasable Programmable Read-Only-Memory (EEPROM), Read-Only-Memory (ROM) or Programmable Read-Only-Memory (PROM). The exemplary memory components are illustrative only; other memory components may also be utilized.

The integrated circuit memory 642 of the exemplary embodiment is typically a serial input/output memory, as are well known in the art. Such memories may have an asynchronous serial data interface, requiring only a single electrical data lead, plus a case ground return, for data input and output. Data input and output from the one wire memory is accomplished via a protocol wherin various length pulses are employed which evidence the beginning of a read/write action. Those pulses are followed by bit-by-bit transfers, wherein ones and zeros are manifest by different pulse lengths. Alternatively, the memories may have a synchronous serial interface including a clock line. Other serial input/output memories may also be employed for the present invention, as well as other, non-serial memory configurations.

U.S. Pat. No. 5,699,091 ("Replaceable Part With Integral Memory For Usage, Calibration And Other Data") assigned to the assignee of the present invention, further describes the use and operation of such a memory device. As described in U.S. Pat. No. 5,699,091, the memory device may be utilized to allow a printer to access replaceable part parameters to insure high print quality. In addition to allowing the printer to optimize print quality, the memory may be used to prevent inadvertent damage to the printer resulting from improper operation, such as operating after the supply of ink is exhausted or operating with the wrong or non-compatible printer components.

When installed in the printing system, the ink container 612 with the memory component 614 is mated to a receiving station 650. The ink container and receiving station may include other interconnections, such as other electrical connections or fluid connections. The receiving station in turn is in data communication with a controller 620, which allows reading of the data in the memory component, such as by the printer firmware.

The memory component may be used as a "smartchip" in the specialized printing system which can be used in a variety of ways to encode information about: (1) the ink, (2) the manufacturer and customer, (3) the printing process, and (4) the cartridge. Data fields within the memory component are typically divided into read-only, write-once, and read/write. Of these, the read-only fields are generally written at manufacturing time and are subsequently only read; the write-once fields can be written once by the manufacturer or the customer and are read-only after that; and the read/write fields can be written and read arbitrarily during the lifetime of the cartridge.

The memory component may store information about the ink in the container, such as an identification of the ink manufacturer; ink color; ink density; ink drop mass; ink drop volume; cartridge ID or serial number; total cartridge volume; production date; and expiration date. The component may also be used to store information about the manufacturer or customer, such as manufacturer or customer ID, or information about the printing process, such as delivered ink volume; capped time and uncapped time; printing time and idle time.

In conjunction with the memory components and ink sensors in the ink containers 112*a*, 112*b*, 112*c*, 112*d*, the controller 160 can allow for sequential use of ink containers, reducing intervention rates; and can prompt an operator when intervention is required. In some specialized printing systems, different inks may be used with different print jobs; the controller may also use information about the print job in conjunction with information about the ink from the memory component to insure that the proper ink has been installed.

Figure 7:
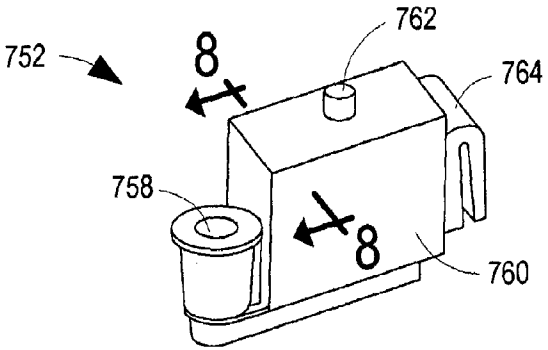
FIG. 7 is an isometric view of a pressure regulator that may be used in embodiments of the ink deliver system.

FIG. 7 is an isometric view of a pressure regulator 752 that may be used in embodiments of the ink deliver system. The exemplary pressure regulator functions in a substantially similar manner to the pressure regulator portion of the ink cartridge described in U.S. Pat. No. 6,203,146 ("Printing System With Air Accumulation Control Means Enabling Semipermanent Printhead Without Air Purge"). Regulator 752 includes a rigid outer shell 760 and a fluid inlet 758 for receiving ink from flexible tubing 142 (ref. FIG. 1). The regulator also includes a barb 762 for connection with tubing 154 for providing ink to cartridges 156*a*, 156*b*, 156*c*. The regulator 752 may also have an attachment member 764 to allow simple physical attachment to the carriages 150*a*, 150*b*, and facilitating easy reconfiguration of the printing system.

Figure 8C:
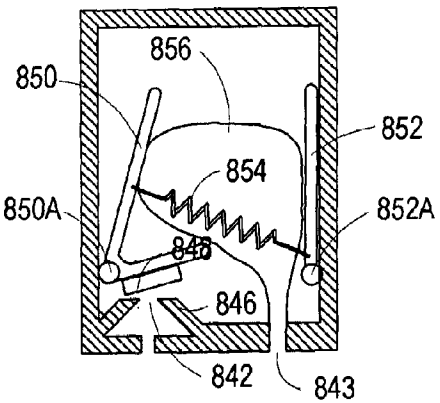
FIGS. 8*a*, 8*b*, and 8*c* are cross sectional schematic representations taken through section 8—8 of FIG. 7.
Figure 8B:
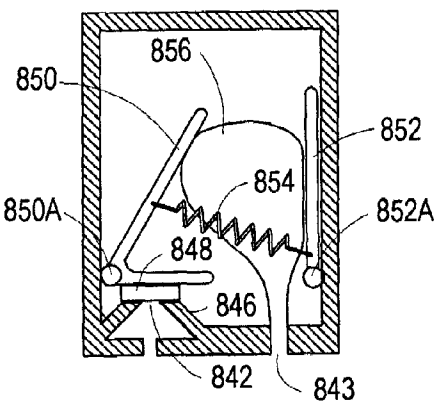
Figure 8A:
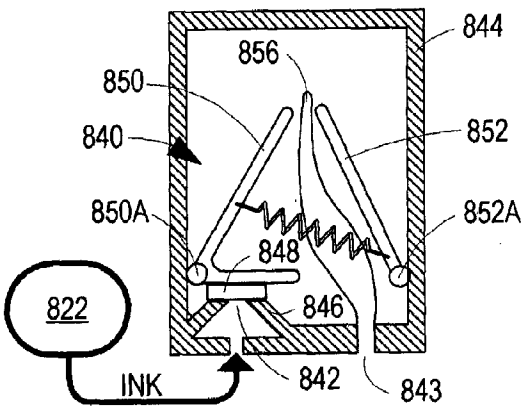

FIGS. 8*a*, 8*b*, and 8*c* are cross sectional schematic representations of regulator 752 taken through section 8—8 of FIG. 7. The internal structure of regulator 752 is simplified to more clearly illustrate functional aspects of the pressure regulation system. In comparing FIGS. 8*a*, 8*b* and 8*c*, similar element numbering is used to identify similar elements.

The regulator includes an outer housing 844 that supports the internal pressure regulating actuator 840. The actuator serves to selectively admit ink into the regulator through a valve mechanism 842. Valve mechanism 842 includes a nozzle 846 that is fluidically connected to fluid inlet 822 for allowing ink to enter the regulator, and a valve seat 848 for sealing nozzle 846. Valve seat 848 is formed of a resilient material to assure reliable sealing of valve 842. Valve seat 848 is fixedly mounted to a pressure regulator lever 850 that rotates about a regulator axle 850A. Rotation of lever 850 opens and closes valve 842 based upon changes in pressure in the regulator.

Regulator 752 also includes an accumulator lever 852 that rotates about an accumulator axle 852A. A spring 854 connects the regulator valve lever 850 to the accumulator lever 852, and biases the levers toward each other. The spring is connected relatively closer to accumulator axle 852A than to regulator axle 850A.

An expandable bag 856 is located between the accumulator lever 852 and the regulator lever 850. A first surface of the expandable bag 856 communicates with outside atmosphere via air conduit 843, and a second surface of the bag 856 is in contact with ink in the regulator. Thus, the bag 856 expands and contracts in response to pressure differences between the ink and outside atmosphere. Together, the bag 856, the regulator lever 850, and the spring 854 function as the actuator 840 mechanism.

FIG. 8*a* illustrates an initial state of regulator 752 when bag 856 is fully collapsed. When printing commences bag 856 expands to compensate for the volume of ink ejected by the printing process. The bag volume increases until it begins pressing on accumulator lever 852 on one side, and regulator lever 850 on the other side, opposing the force exerted by spring 854. When the pressure in bag 856 is high enough, the levers begin to pivot outwardly in opposition.

The accumulator lever 852 moves first, since the moment exerted by spring 854 on accumulator lever 852 is less than the moment exerted by spring 854 on regulator lever 850. The accumulator lever moves until it contacts outer housing 844, as indicated by FIG. 8*b*.

When the accumulator lever 852 is fully extended, the regulator lever 850 begins to move, until valve seat 848 is lifted away from nozzle 846, opening valve 842, as shown in FIG. 8*c*. Then ink flows through nozzle 846, and into the regulator. The incoming ink increases the pressure in the regulator, reducing the force of bag 856 on the levers 850 and 852, and allowing valve 842 to close. The regulator is then in the state illustrated with respect to FIG. 8*b*.

As discussed before, it is important that negative pressure be maintained for proper operation of the printing system. The accumulator functions to maintain this negative pressure even with air present in the regulator. Because of the relative attachment points of spring 854, the accumulator lever remains pressed against housing 844 during normal operation. Over time, air may tend to accumulate in the regulator. During storage and idle periods of printing system, environmental temperatures can vary. According to the ideal gas law, air expands in response to a rising temperature, causing bag 856 to collapse in response. As bag 856 collapses, accumulator lever 852 then moves to maintain pressure on bag 856. The accumulator lever 852 and bag 856 thereby assure a constant negative pressure in the regulator to prevent positive pressure throughout the accumulator lever 852 range of motion.

Figure 9:
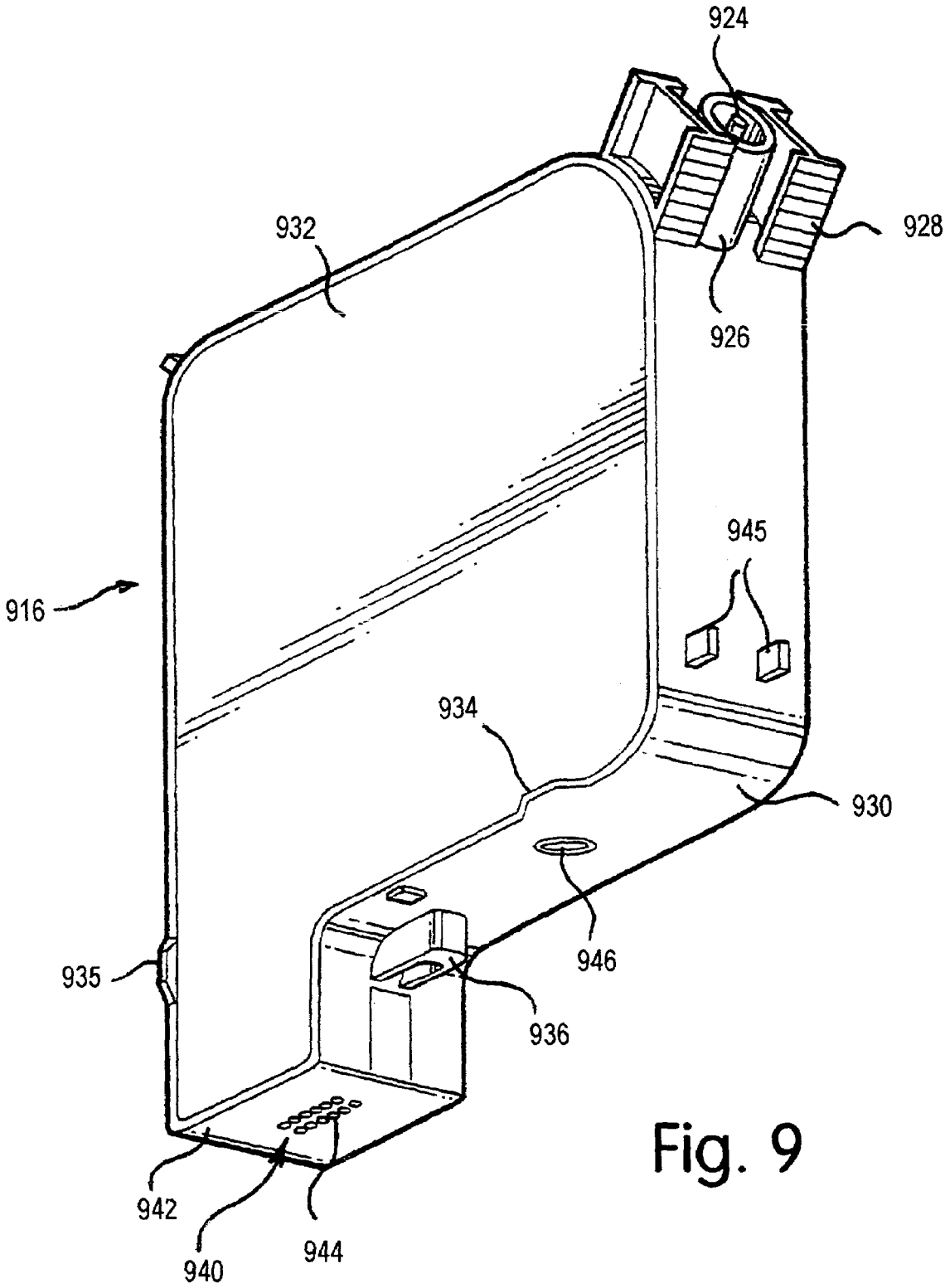
FIG. 9 is an isometric view of an ink-jet print cartridge that may be utilized in the system of FIG. 1.

FIG. 9 is an isometric view of an inkjet print cartridge 916 that may be utilized in the system of FIG. 1. The cartridges may be of the type described in U.S. Pat. No. 6,341,853 ("Continuous refill of spring bag reservoir in an ink-jet swath printer/plotter").

Each print cartridge 916 is removable and engages with fixed electrodes (not illustrated) on carriage assembly mechanical housing 158 (ref. FIG. 1) to provide the electrical signals to the printheads within each of print cartridges 916. Each of print cartridges 916 contains a valve 924 which may be opened and closed. In an open state, ink from an external ink supply may flow through valve 924 and into the ink reservoir within print cartridge 916. Valve 924 is surrounded by a cylindrical plastic sleeve 926, which generally forms part of a handle 928 for allowing the user to easily grasp print cartridge 916 for insertion into and removal from mechanical housing 158.

The outer frame 930 of print cartridge 916 is typically formed of molded engineering plastic such as the material marketed under the trademark "NORYL" by General Electric Company. Side covers 932 may be formed of metal or plastic. Datums 934, 935, and 936 affect the position of the print cartridge 16 when installed in mechanical housing 158. Plastic tabs 945 are used to prevent a particular print cartridge 196 from being inserted into the wrong slot in the carriage assembly. Tabs 945 are different for the black, cyan, magenta, and yellow print cartridges. Nozzle member 940 consists of a strip of flexible tape 942 having nozzles 944 formed in the tape 942 using laser ablation. A fill hole 946 is provided for initially filling the ink reservoir in print cartridge 916 by the manufacturer. This hole 946 is later sealed with a steel ball, which is intended to be permanent.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. An ink delivery system for printing, comprising:

a plurality of ink containers, the ink containers fluidically coupled to a fluidically common ink manifold;

the ink manifold fluidically coupled to a pressure regulator;

the pressure regulator fluidically coupled to multiple print cartridges, the regulator maintaining a backpressure on ink flowing to the print cartridges, such that ink from any one of the plurality of ink containers may be provided to any one of the multiple print cartridges through the common ink manifold.

2. The ink delivery system of claim 1, wherein the plurality of ink containers are free ink containers.

3. The ink delivery system of claim 2, wherein the ink containers have a first port for providing ink and a second port for admitting air.

4. The ink delivery system of claim 1, further comprising a receiving station configured to hold the plurality of ink containers.

5. The ink delivery system of claim 1, further comprising a plurality of valves, with a valve interposed between each ink container and the common ink manifold, the valves operable to interrupt the flow of ink from an ink container to the manifold.

6. The ink delivery system of claim 1, wherein the pressure regulator and the multiple print cartridges are mounted on a printer carriage assembly.

7. The ink delivery system of claim 1, further comprising an electronic controller.

8. The ink delivery system of claim 7, further comprising a plurality of valves, with a valve interposed between each ink container and the common ink manifold, the valves operable to interrupt the flow of ink from an ink container to the manifold.

9. The ink delivery system of claim 8, wherein the electronic controller controls the plurality of valves.

10. The ink delivery system of claim 7, wherein each of the plurality of ink containers further comprises an integral electronic memory component, each of the integral electronic memory components in electrical communication with the electronic controller.

11. The ink delivery system of claim 10, wherein each integral electronic memory component includes information regarding the characteristics of the ink within the container with which the memory component is integral.

12. The ink delivery system of claim 11, wherein the electronic controller includes information regarding the type of ink required for a print job, and wherein the electronic controller compares the information regarding the type of ink required for a print job to the information regarding the characteristics of the ink within a container.

13. An ink delivery system for printing, comprising:

a plurality of ink containers;

a plurality of valves, each of the plurality of ink containers fluidically coupled to a valve, the valves operable to interrupt the flow of ink from an ink container;

an ink manifold, each of the plurality of valves fluidically coupled to the manifold;

a carriage assembly, the carriage assembly having a common pressure regulator, the pressure regulator fluidically coupled to the ink manifold;

multiple print cartridges, each of the print cartridges fluidically coupled to the common pressure regulator, the regulator maintaining a backpressure on ink flowing to the print cartridges, such that ink from any one of the plurality of ink containers may be provided to any one of the multiple print cartridges through the common ink manifold.

14. The ink delivery system of claim 13, wherein each of the plurality of ink containers have a first port for providing ink and a second port for admitting air.

15. The ink delivery system of claim 13, further comprising a receiving station configured to hold the plurality of ink containers.

16. The ink delivery system of claim 13, further comprising an electronic controller.

17. The ink delivery system of claim 16, wherein the electronic controller controls the plurality of valves.

18. The ink delivery system of claim 16, wherein each of the plurality of ink containers further comprises an integral electronic memory component, each of the integral electronic memory components in electrical communication with the electronic controller.

19. The ink delivery system of claim 18, wherein each integral electronic memory component includes information regarding the characteristics of the ink within the container with which the memory component is integral.

20. The ink delivery system of claim 11, wherein the electronic controller includes information regarding the type of ink required for a print job, and wherein the electronic controller compares the information regarding the type of ink required for a print job to the information regarding the characteristics of the ink within a container.

* * * * *

UNITED STATES PATENT AND TRADEMARK OFFICE

CERTIFICATE OF CORRECTION

PATENT NO. : 7,168,798 B2
APPLICATION NO. : 10/832069
DATED : January 30, 2007
INVENTOR(S) : Mohammad M. Samii et al.

It is certified that error appears in the above-identified patent and that said Letters Patent is hereby corrected as shown below:

On the face page, in field (57), under "Abstract", in column 2, line 7, delete "in" and insert -- ink --, therefor.

Signed and Sealed this

Second Day of December, 2008

JON W. DUDAS
*Director of the United States Patent and Trademark Office*